US012575633B2

(12) United States Patent
Lee et al.

(10) Patent No.: US 12,575,633 B2
(45) Date of Patent: Mar. 17, 2026

(54) ROTATING BODY FIXING MEANS FOR HELMET

(71) Applicant: HJC CORP., Gyeonggi-do (KR)

(72) Inventors: Jin Hwan Lee, Gyeonggi-do (KR); Ki Young Nam, Seoul (KR)

(73) Assignee: HJC CORP., Gyeonggi-do (KR)

( * ) Notice: Subject to any disclaimer, the term of this patent is extended or adjusted under 35 U.S.C. 154(b) by 0 days.

(21) Appl. No.: 18/686,211

(22) PCT Filed: Aug. 12, 2022

(86) PCT No.: PCT/KR2022/012078
§ 371 (c)(1),
(2) Date: Feb. 23, 2024

(87) PCT Pub. No.: WO2023/054891
PCT Pub. Date: Apr. 6, 2023

(65) Prior Publication Data

US 2024/0365910 A1 Nov. 7, 2024

(30) Foreign Application Priority Data

Sep. 29, 2021 (KR) ..... 10-2021-0128557

(51) Int. Cl.
*A42B 3/22* (2006.01)
*A42B 3/20* (2006.01)

(52) U.S. Cl.
CPC ..... *A42B 3/223* (2013.01); *A42B 3/205* (2013.01)

(58) Field of Classification Search
CPC ..... A42B 3/223; A42B 3/205; A42B 3/326
See application file for complete search history.

(56) References Cited

U.S. PATENT DOCUMENTS

| | | | | |
|---|---|---|---|---|
| 4,769,857 | A | 9/1988 | Cianfanelli | |
| 5,444,875 | A | 8/1995 | Taniuchi | |
| 6,237,161 | B1 * | 5/2001 | Lee | A42B 3/326 2/424 |
| 2003/0182716 | A1 * | 10/2003 | Wu | A42B 3/326 2/424 |
| 2008/0216215 | A1 * | 9/2008 | Lee | A42B 3/326 2/10 |
| 2011/0302701 | A1 * | 12/2011 | Kuo | A42B 3/326 2/424 |
| 2012/0284906 | A1 * | 11/2012 | Kuo | A42B 3/223 2/424 |
| 2013/0025015 | A1 | 1/2013 | Isobe | |

(Continued)

FOREIGN PATENT DOCUMENTS

| | | |
|---|---|---|
| WO | 01-58296 | 8/2001 |
| WO | 2006-045912 | 5/2006 |

*Primary Examiner* — Khaled Annis
(74) *Attorney, Agent, or Firm* — DUANE MORRIS LLP; Gregory M. Lefkowitz; Daniel J. Tarr

(57) ABSTRACT

The present disclosure relates to a rotating body fixing means for a helmet. The rotating body fixing means for a helmet, according to the present disclosure, is provided at the helmet comprising a helmet body (10) and a rotating body (20) rotatably coupled to the helmet body (10), and comprises a fixing part (100), which is slidably disposed at one side of the helmet body (10), slides such that the protruding degree thereof from the helmet body (10) varies, and comes in contact with the rotating body (20) when protruding from the helmet body (10).

20 Claims, 13 Drawing Sheets

(56) References Cited

U.S. PATENT DOCUMENTS

| | | | | |
|---|---|---|---|---|
| 2013/0340148 | A1 | 12/2013 | Arai | |
| 2016/0015114 | A1 | 1/2016 | Berthier | |
| 2020/0178639 | A1* | 6/2020 | Jwa | A42B 3/205 |
| 2020/0253316 | A1* | 8/2020 | Isobe | A42B 3/226 |
| 2022/0408870 | A1 | 12/2022 | Lee | |
| 2023/0292875 | A1* | 9/2023 | Guazzerotti | A42B 3/222 2/427 |
| 2024/0065364 | A1* | 2/2024 | Lee | A42B 3/205 |
| 2024/0081463 | A1* | 3/2024 | Lee | A42B 3/222 |
| 2024/0180282 | A1* | 6/2024 | Lee | A42B 3/223 |
| 2024/0365910 | A1* | 11/2024 | Lee | A42B 3/205 |

* cited by examiner

ROTATING BODY FIXING MEANS FOR HELMET

CROSS-REFERENCE TO RELATED APPLICATIONS

This application is a § 371 national stage entry of International Application No. PCT/KR2022/012078, filed on Aug. 12, 2022, which claims priority to Korean Patent Application No. 10-2021-0128557, filed on Sep. 29, 2021, the entire contents of which are incorporated herein by reference.

TECHNICAL FIELD

The present disclosure relates to a rotating body fixing means for a helmet.

BACKGROUND ART

In general, it is mandatory to wear a helmet while driving a two wheeled vehicle with high speed to protect the wearer's head. The helmet has a front open portion to ensure the wearer's frontal field of view. Additionally, the helmet may include a shield that can selectively open and close the open portion to keep out wind, dust, etc. while driving.

Meanwhile, the conventional helmet includes a chin guard to protect the wearer's chin as disclosed in the patent literature of the related literatures described below.

Among the conventional helmets, a system helmet operates in a full face mode in which the chin guard closes the front side and an open face mode in which the chin guard opens the front side.

On the other hand, among the conventional helmets, a rotation helmet operates in a full face mode in which the chin guard closes the front side and an open face mode in which the chin guard moves to the rear side of the helmet to open the wearer's front side.

However, the conventional helmets do not have a means for stably fixing the chin guard in the full face mode and the open face mode, or even though there is such a fixing means, the fixing means is formed with a complicated structure in a ratchet, resulting in increased manufacturing cost.

RELATED LITERATURES

Patent Literature (Patent Literature 1) KR10-2014-0001141 A

DISCLOSURE

Technical Problem

The present disclosure is designed to solve the above-described problem, and an aspect of the present disclosure is directed to providing a rotating body fixing means for a helmet for fixing a rotating body in a simple and stable manner using a fixing portion that changes in extent to which it protrudes from a helmet body as it slides.

Technical Solution

A rotating body fixing means for a helmet according to an embodiment of the present disclosure is provided in the helmet including a helmet body and a rotating body rotatably coupled to the helmet body, and includes a fixing portion that is slidably disposed on one side of the helmet body, wherein extent of protrusion of the fixing portion with respect to the helmet body varies as the fixing portion slides, and the fixing portion is configured to come into contact with the rotating body when protruded from the helmet body.

Additionally, in the rotating body fixing means for the helmet according to an embodiment of the present disclosure, the rotating body rotates between a first predefined position with respect to the helmet body and a second predefined position with respect to the helmet body, and when the rotating body is in the second predefined position, the fixing portion protrudes from the helmet body and comes into contact with the rotating body.

Additionally, in the rotating body fixing means for the helmet according to an embodiment of the present disclosure, the rotating body is a chin guard.

Additionally, the rotating body fixing means for the helmet according to an embodiment of the present disclosure further includes a guide portion disposed in the helmet body to guide the fixing portion such that extent of protrusion of the fixing portion with respect to the helmet body varies as the fixing portion slides.

Additionally, in the rotating body fixing means for the helmet according to an embodiment of the present disclosure, any one of the fixing portion and the guide portion has a protruding portion that protrudes toward the other of the fixing portion and the guide portion, and the other of the fixing portion and the guide portion has a slit into which the protruding portion is inserted.

Additionally, in the rotating body fixing means for the helmet according to an embodiment of the present disclosure, when the fixing portion has the protruding portion and the guide portion has the slit, the slit extends from one side to the other side along a lengthwise direction of the guide portion, and extends in an outward direction of the helmet body from one side to the other side.

Additionally, in the rotating body fixing means for the helmet according to an embodiment of the present disclosure, when the guide portion has the protruding portion and the fixing portion has the slit, the protruding portion extends from one side to the other side along a lengthwise direction of the guide portion, and extends in an outward direction of the helmet body from one side to the other side.

Additionally, in the rotating body fixing means for the helmet according to an embodiment of the present disclosure, the guide portion includes a first guide member formed inside the helmet body, and a second guide member coupled to the first guide member, and the slit is formed between the first guide member and the second guide member.

Additionally, in the rotating body fixing means for the helmet according to an embodiment of the present disclosure, the guide portion has a protrusion portion that extends along a lengthwise direction and protrudes toward the fixing portion, and the fixing portion has a recess portion into which the protrusion portion is inserted.

Additionally, in the rotating body fixing means for the helmet according to an embodiment of the present disclosure, the fixing portion is provided with an elastic member, and when the elastic member comes into contact with the guide portion, the elastic member compresses the fixing portion in an outward direction of the helmet body.

Additionally, in the rotating body fixing means for the helmet according to an embodiment of the present disclosure, the fixing portion is provided with an elastic member, and the guide portion has a first step, against which the elastic member is held.

Additionally, in the rotating body fixing means for the helmet according to an embodiment of the present disclosure, the fixing portion is provided with an elastic member, the elastic member compresses the fixing portion in a direction, and when the protruding portion of the fixing portion goes through a second step of the guide portion, one side of the protruding portion is held against the second step.

Additionally, in the rotating body fixing means for the helmet according to an embodiment of the present disclosure, the elastic member is a torsion spring.

Additionally, in the rotating body fixing means for the helmet according to an embodiment of the present disclosure, the fixing portion has a first groove portion that is recessed, and when the fixing portion comes into contact with the rotating body, one side of the rotating body is inserted into the first groove portion.

Additionally, in the rotating body fixing means for the helmet according to an embodiment of the present disclosure, the first groove portion has a second groove portion that is recessed, and with the rotation of the rotating body, a corner of the rotating body is inserted into the second groove portion.

The features and advantages of the present disclosure will be apparent from the following detailed description in accordance with the accompanying drawings.

Prior to the description, it should be understood that the terms or words used in the specification and the appended claims should not be construed as limited to general and dictionary meanings, but rather interpreted based on the meanings and concepts corresponding to the technical spirit of the present disclosure on the basis of the principle that the inventor is allowed to define terms appropriately for the best explanation.

Advantageous Effects

According to the present disclosure, it may be possible to fix the rotating body in a simple and stable manner using the fixing portion that changes in the extent to which it protrudes from the helmet body as it slides.

BEST MODE

The objectives, particular advantages and new features of the present disclosure will be apparent from the following detailed description and exemplary embodiments in association with the accompanying drawings. In affixing the reference numbers to the elements of each drawing in the present disclosure, it should be noted that identical elements are given as identical numbers as possible although they are depicted in different drawings. Additionally, the terms such as "first", "second" or the like are used to distinguish one element from another, and the elements are not limited by the terms. Hereinafter, in describing the present disclosure, when it is determined that a certain description of related known technology may unnecessarily obscure the subject matter of the present disclosure, the detailed description is omitted.

Hereinafter, exemplary embodiments of the present disclosure will be described in detail with reference to the accompanying drawings.

Figure 1A:
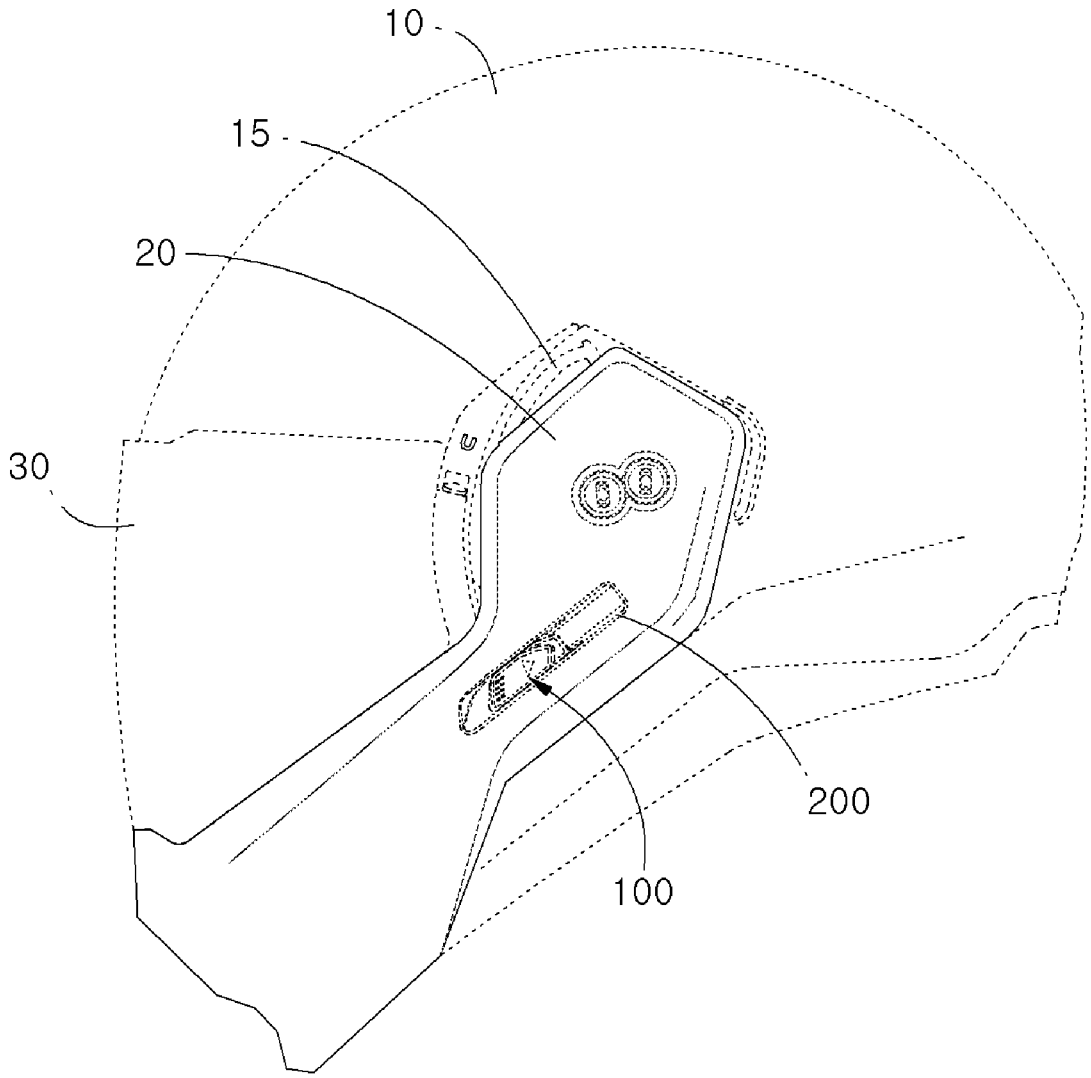
FIGS. 1A and 1B are side views of a helmet with a rotating body fixing means for the helmet according to an embodiment of the present disclosure.
Figure 1B:
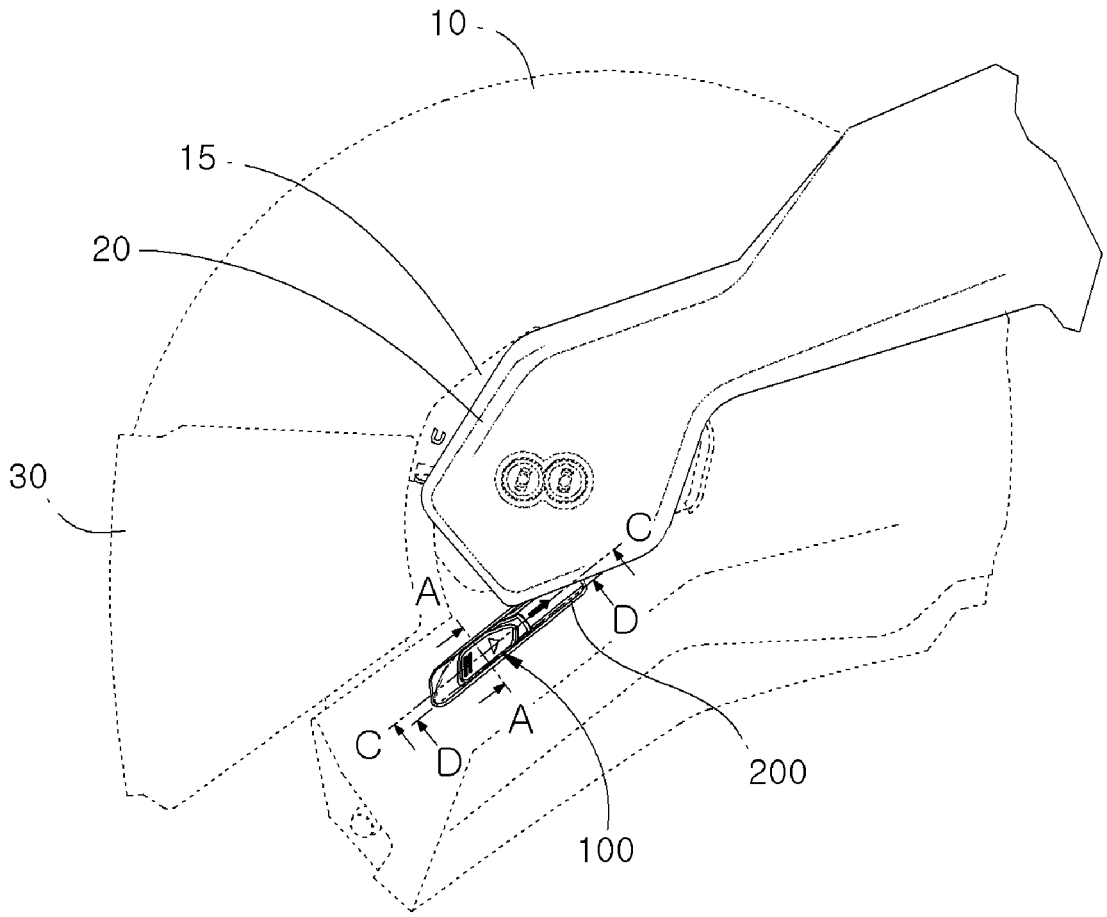
Figure 2:
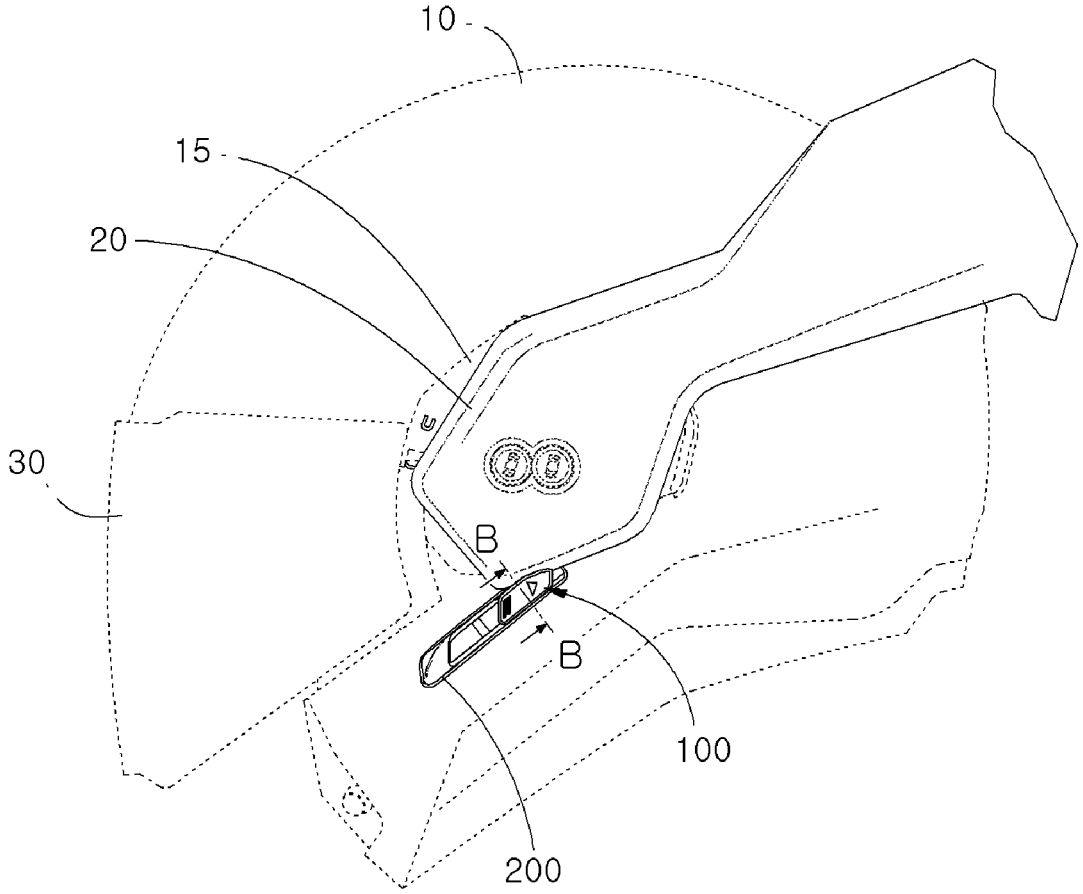
FIG. 2 is a side view of a helmet with a rotating body fixing means for the helmet according to an embodiment of the present disclosure.

FIGS. 1A and 1B are side views of a helmet with a rotating body fixing means for the helmet according to an embodiment of the present disclosure, and FIG. 2 is a side view of the helmet with the rotating body fixing means for the helmet according to an embodiment of the present disclosure.

As shown in FIGS. 1A, 1B and 2, the rotating body fixing means for the helmet according to this embodiment is provided in the helmet including a helmet body 10, and a rotating body 20 rotatably coupled to the helmet body 10, and includes a fixing portion 100 that is slidably disposed on one side of the helmet body 10, wherein extent of protrusion of the fixing portion 100 with respect to the helmet body 10 varies as the fixing portion 100 slides, and the fixing portion 100 is configured to come into contact with the rotating body 20 when protruded from the helmet body 10.

Basically, the helmet body 10 plays a role in protecting a wearer's head. The helmet body 10 may be made of a shock absorbing material. For example, the helmet body 10 may include an outer shell of hard synthetic resin and having high strength, and an absorber disposed in the outer shell, made of an expanded polystyrene (EPS) foam and having proper strength and elasticity. A pad may be present inside the absorber to improve a snug fit.

Additionally, the chin guard 20 plays a role in protecting the wearer's chin, and may be extended in such an arc shape as a whole that it is disposed at the front side of the wearer's chin. In this instance, the chin guard 20 may be rotatable with two ends rotatably coupled to two sides (for example, a ratchet 15) of the helmet body 10. For example, with the rotation of the chin guard 20, the chin guard 20 may be disposed at the front side of the wearer's chin (Full Face Mode) (see FIG. 1A) and the rear side of the helmet body 10 (Open Face Mode) (see FIG. 1B).

Meanwhile, a shield 30 plays a role in opening and closing an open portion formed at the front side of the helmet body 10, and may be rotatably coupled to the two sides (for example, the ratchet 15) of the helmet body 10 and rotate with respect to the helmet body 10 to open and close the open portion.

In the rotating body fixing means for the helmet according to this embodiment, the rotating body may be, for example, the chin guard 20. Accordingly, the following description is made on the basis that the rotating body is the chin guard 20. However, the rotating body is not necessarily limited to the chin guard 20, and may be any configuration, for example, the shield 30 rotatably coupled to the helmet body 10.

The fixing portion 100 of the rotating body fixing means for the helmet according to this embodiment may be disposed on one side of the helmet body 10. For example, the fixing portion 100 may be disposed below the ratchet 15 of the helmet body 10, but is not necessarily limited thereto. Here, the fixing portion 100 is slidable with respect to the helmet body 10, and changes in the extent to which it protrudes from the helmet body 10 as it slides. When the fixing portion 100 protrudes from the helmet body 10, one surface (upper surface) of the fixing portion 100 contacts one side (lower side) of the chin guard 20, thereby stably fixing the chin guard 20 (see FIG. 2). Specifically, the chin guard 20 may rotate between a first predefined position (Full Face Mode) (see FIG. 1A) with respect to the helmet body 10 and a second predefined position (Open Face Mode) (see FIG. 1B) with respect to the helmet body 10. When the chin guard 20 is in the second predefined position, since the fixing portion 100 protrudes from the helmet body 10 and comes into contact with the chin guard 20, the chin guard 20 may be kept in the second predefined position (see FIG. 2). For example, the first predefined position may be the front side of the wearer's chin (Full Face Mode) (see FIG. 1A), and the second predefined position may be the rear side of the helmet body 10 (Open Face Mode) (see FIG. 1B). Accordingly, when the chin guard 20 is disposed on the rear side of the helmet body 10, the chin guard 20 may be fixed by the fixing portion 100 (see FIG. 2). However, this is provided by way of illustration, and the second predefined position may be the upper side of the helmet body 10. In this case, when the chin guard 20 is disposed on the upper side of the helmet body 10, the chin guard 20 may be fixed by the fixing portion 100.

Figure 3:
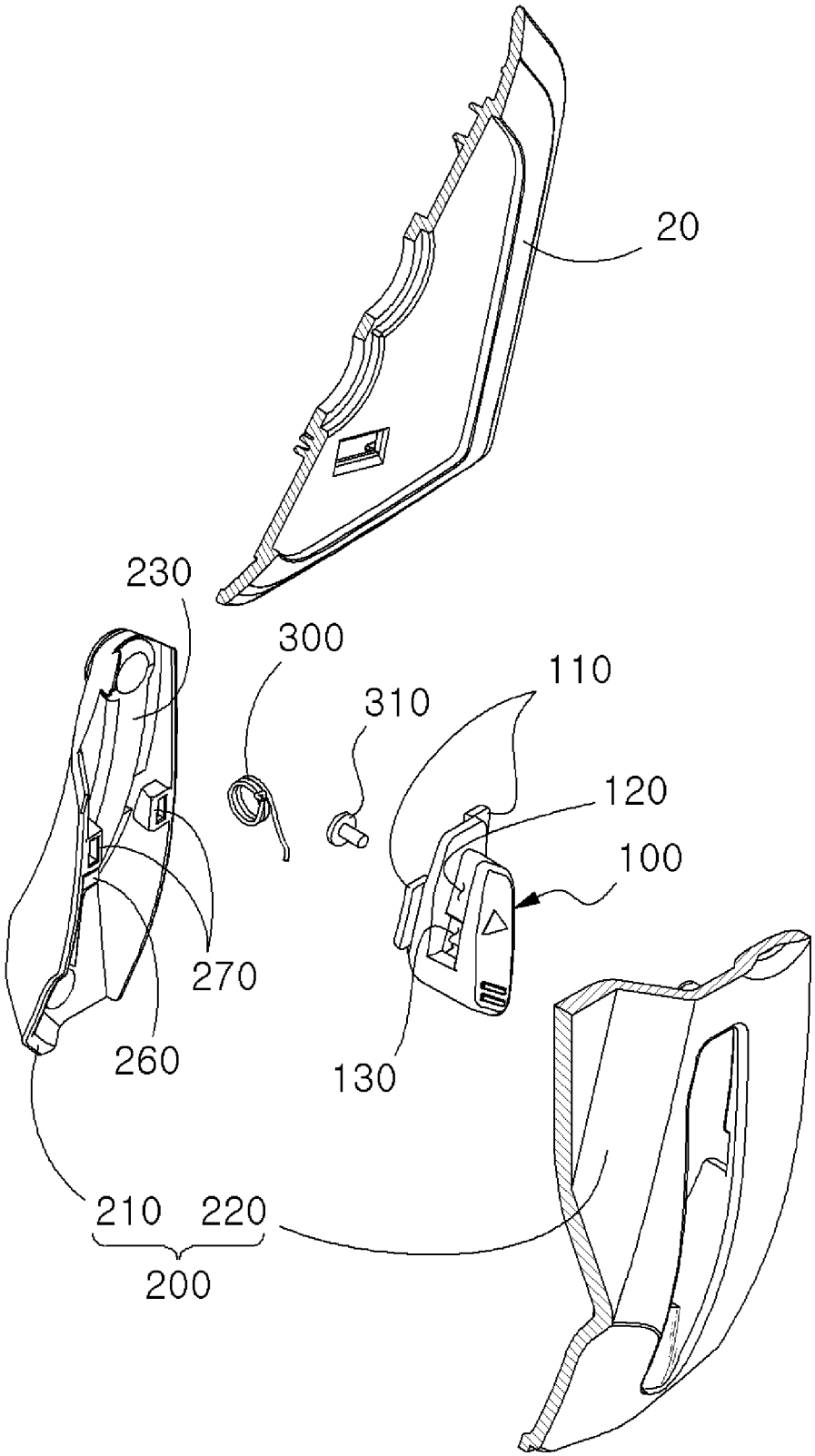
FIG. 3 is an exploded perspective view of a rotating body fixing means for a helmet according to an embodiment of the present disclosure.
Figure 4:
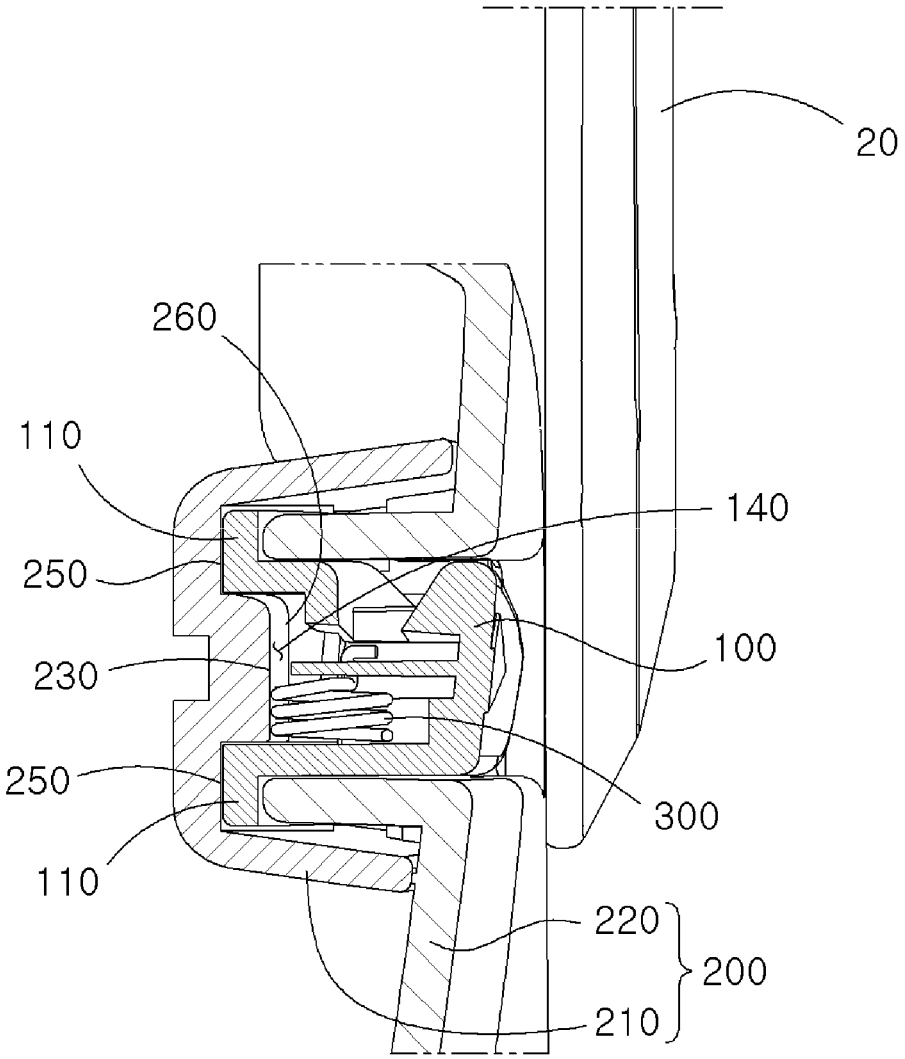
FIG. 4 is a cross-sectional view of FIG. 1B, taken along the line A-A.
Figure 5:
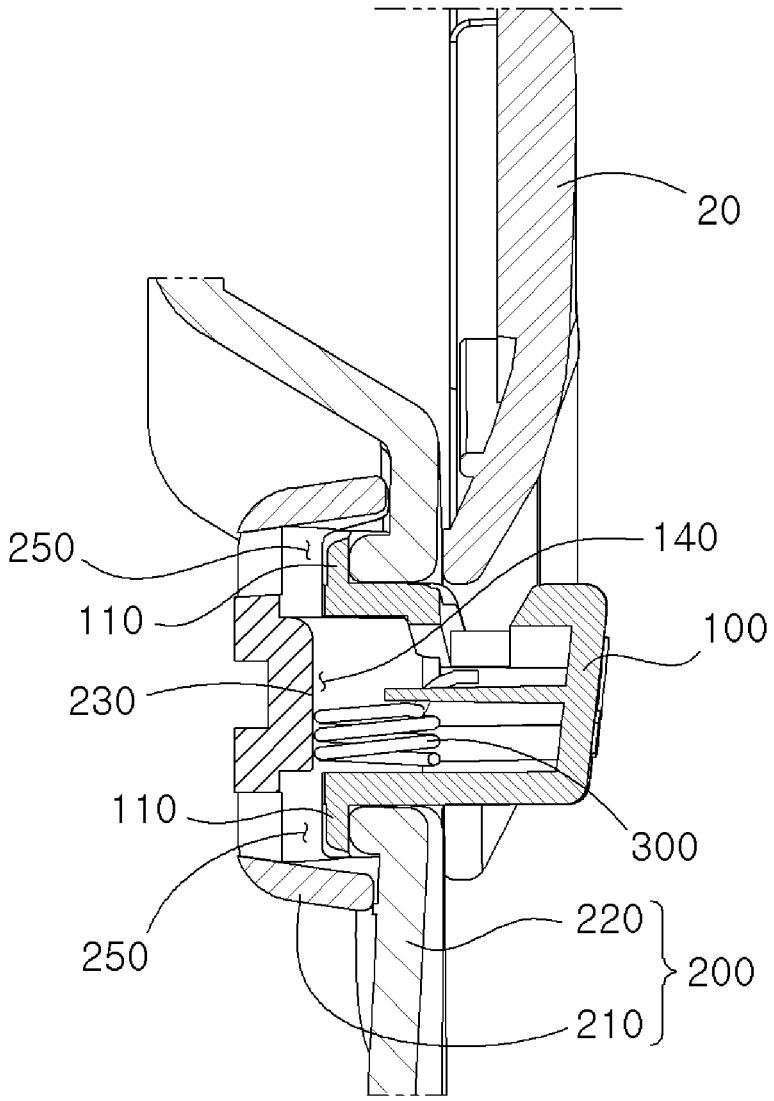
FIG. 5 is a cross-sectional view of FIG. 2, taken along the line B-B.

Meanwhile, the helmet body 10 may be provided with a guide portion 200 to guide the fixing portion 100. Here, the guide portion 200 plays a role in guiding the fixing portion 100 with changes in extent to which the fixing portion 100 protrudes as it slides. As shown in FIGS. 3 to 5, the fixing portion 100 may have a protruding portion 110 protruding toward the guide portion 200, and the guide portion 200 may have a slit 250 into which the protruding portion 110 is inserted. In this instance, the slit 250 may extend along the lengthwise direction of the guide portion 200, and when the protruding portion 110 is inserted into the slit 250, the protruding portion 110 may move in the lengthwise direction of the guide portion 200. Thus, the fixing portion 100 having the protruding portion 110 may slide along the guide portion 200 having the slit 250. More specifically, the slit 250 may extend from one side to the other side along the lengthwise direction of the guide portion 200, and extend in the outward direction of the helmet body 10 from one side to the other side. Accordingly, as the fixing portion 100 having the protruding portion 110 slides along the guide portion 200 having the slit 250 from one side of the guide portion 200 to the other side, the protruding portion 110 may protrude in the outward direction of the helmet body 10. For example, the slit 250 may extend from the front side to the rear side and extend in the outward direction of the helmet body 10 from the front side to the rear side, and the fixing portion 100 having the protruding portion 110 may protrude in the outward direction of the helmet body 10 as it slides from the front side to the rear side. As described above, when the protruding portion 110 protrudes in the outward direction of the helmet body 10, one surface (upper surface) of the protruding portion 110 may contact one side (lower side) of the chin guard 20, thereby stably fixing the chin guard 20.

Although the foregoing description is made based on the fixing portion 100 having the protruding portion 110 and the guide portion 200 having the slit 250, the scope of protection of the present disclosure is not limited thereto, and the guide portion 200 may have the protruding portion 110 and the fixing portion 100 may have the slit 250. In this instance, the protruding portion 110 may extend from one side to the other side along the lengthwise direction of the guide portion 200, and extend in the outward direction of the helmet body 10 from one side to the other side.

Describing the guide portion 200 in more detail, the guide portion 200 may include a first guide member 210 and a second guide member 220 (see FIG. 3). Here, the first guide member 210 may be formed inside the helmet body 10, and the second guide member 220 may be coupled to the first guide member 210 to cover the first guide member 210. In this instance, the slit 250 may be formed between the first guide member 210 and the second guide member 220 (see FIGS. 4 and 5). Thus, the protruding portion 110 of the fixing portion 100 may slide along the slit 250 formed between the first and second guide members 210, 220 when it is inserted into the slit 250. In this instance, two slits 250 may be formed, one at the upper part of the fixing portion 100 and one at the lower part of the fixing portion 100, and to correspond to the slits 250, two protruding portions 110 may be formed, one on the upper surface of the fixing portion 100 and one on the lower surface of the fixing portion 100.

Meanwhile, the guide portion 200 may have a protrusion portion 230 that extends along the lengthwise direction and protrudes toward the fixing portion 100 (see FIG. 3). For example, the protrusion portion 230 may protrude from one surface (a surface facing the fixing portion 100) of the first guide member 210 toward the fixing portion 100 (see FIG. 4). To correspond to it, the lateral surface of the fixing portion 100 (a surface facing the first guide member 210) may have a recess portion 140 into which the protrusion portion 230 is inserted. Thus, the fixing portion 100 may slide in a state that the protrusion portion 230 of the guide portion 200 is inserted into the recess portion 140 of the fixing portion 100. Accordingly, the fixing portion 100 may be guided by not only the protruding portion 110 and the slit 250 but also the protrusion portion 230 and the recess portion 140, thereby achieving stable sliding.

Additionally, the fixing portion 100 may be provided with an elastic member 300 having elasticity, and when the elastic member 300 comes into contact with the guide portion 200, the elastic member 300 may compress the fixing portion 100 in the outward direction of the helmet body 10 due to its elasticity. For example, the elastic member 300 may be disposed in the recess portion 140 of the fixing portion 100, and when the elastic member 300 comes into contact with one surface (a surface facing the fixing portion 100, the protrusion portion 230) of the first guide member 210, the elastic member 300 may compress the fixing portion 100 in the outward direction of the helmet body 10 due to its elasticity. As described above, since the fixing portion 100 is compressed by the elastic member 300, when the fixing portion 100 slides from one side of the guide portion 200 to the other side, the fixing portion 100 may be always compressed in such a direction that it protrudes from the helmet body 10. As shown in FIG. 5, when there is a gap between the protruding portion 110 and the slit 250, the fixing portion 100 may be compressed by the elastic member 300 and protruded from the helmet body 10 until the protruding portion 110 of the fixing portion 100 contacts the outer surface of the slit 250 (a surface where the second guide member 220 is present). Here, the elastic member 300 is not limited to a particular type so long as it has elasticity, but may be, for example, a torsion spring. Specifically, two ends of the torsion spring may be coupled to the fixing portion 100 using a fastening member 310 (see FIG. 3), and as shown in FIGS. 4 and 5, when the outer peripheral surface of the torsion spring contacts one surface (a surface facing the fixing portion 100, the protrusion portion 230) of the first guide member 210, the fixing portion 100 may be compressed in the outward direction of the helmet body 10.

Figure 6:
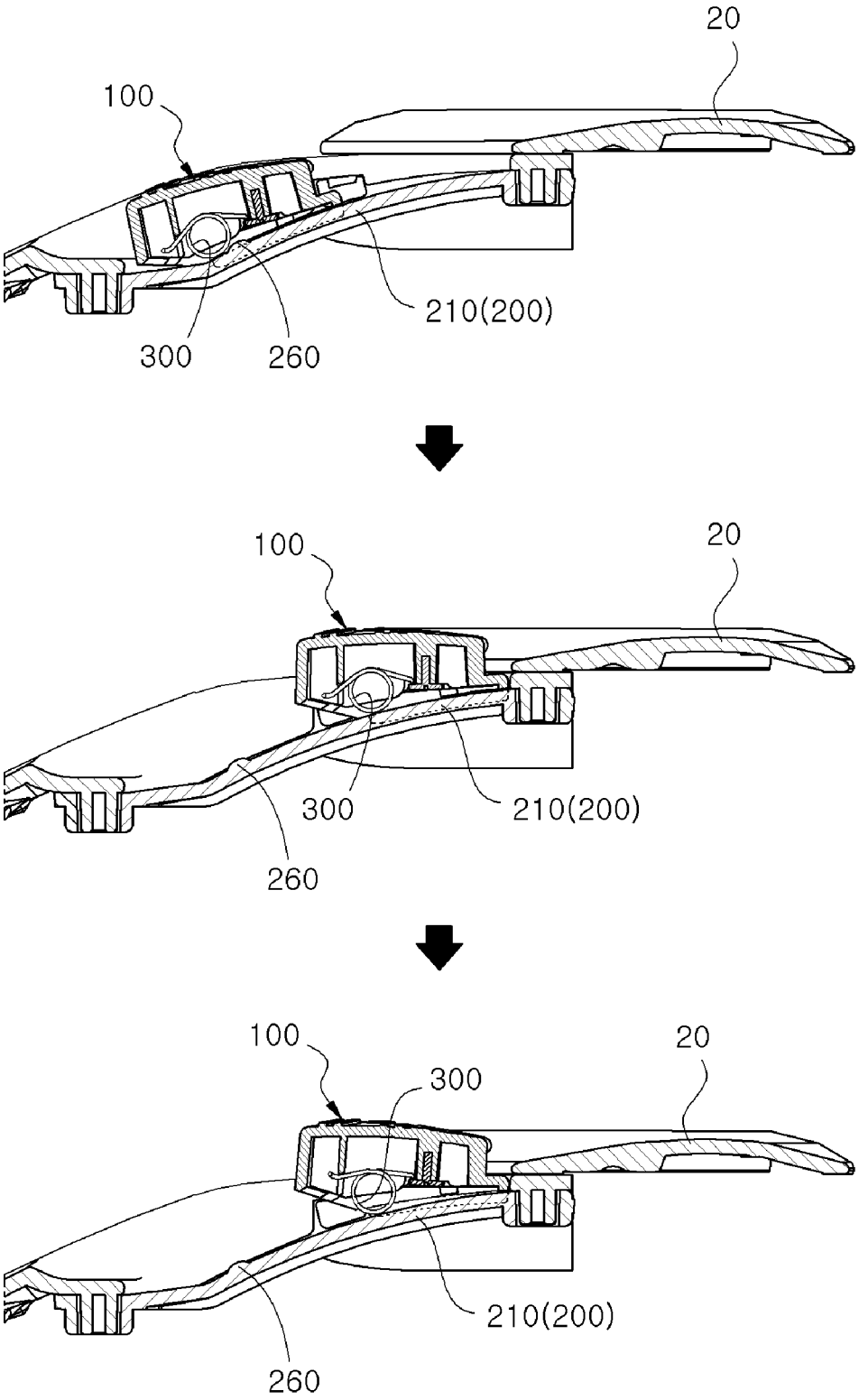
FIG. 6 is a cross-sectional view of FIG. 1B, taken along the line C-C.

As shown in FIG. 6, the guide portion 200 may have a first step 260, and the elastic member 300 may be held against the first step 260. For example, the first step 260 may be formed on one side (front side) of the protrusion portion 230 of the first guide member 210. Accordingly, when the fixing portion 100 is disposed on one side (front side) of the guide portion 200, the elastic member 300 may be held against the first step 260, thereby preventing the fixing portion 100 from arbitrarily sliding to the other side (rear side) of the guide portion 200. When the wearer applies an external force to the fixing portion 100 towards the other side (rear side) of the guide portion 200, the elastic member 300 may deform and move over the first step 260, and the fixing portion 100 may slide to the other side (rear side) of the guide portion 200.

Figure 7:
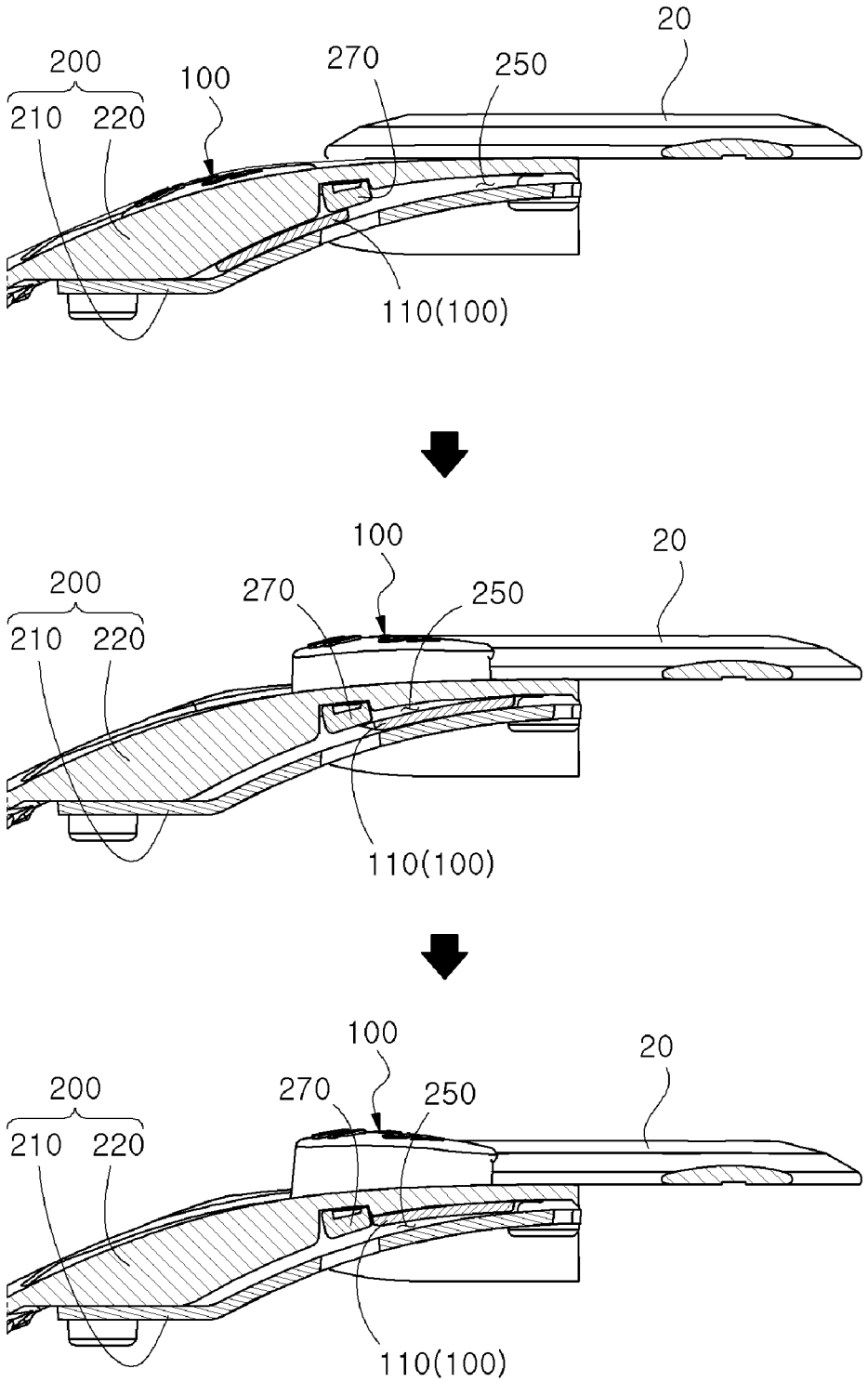
FIG. 7 is a cross-sectional view of FIG. 1B, taken along the line D-D.

Additionally, as shown in FIG. 7, the guide portion 200 may have a second step 270, and the protruding portion 110 compressed in a direction (the outward direction of the helmet body 10) by the elastic member 300 may be held against the second step 270. Specifically, when the protruding portion 110 of the fixing portion 100 slides from one side (front side) of the guide portion 200 to the other side (rear side) and goes through the second step 270 of the guide portion 200, one side of the protruding portion 110 may be held against the second step 270 of the guide portion 200. For example, the second step 270 may be formed at the center of the guide portion 200 such that it protrudes from the slit 250. Accordingly, when the fixing portion 100 slides from one side (front side) to the other side (rear side) and is disposed on the other side (rear side) of the guide portion 200, the end of the protruding portion 110 may be held against the second step 270. In particular, since elasticity acts on the fixing portion 100 in the outward direction of the helmet body 10 by the elastic member 300, the end of the protruding portion 110 may be kept held against the second step 270, thereby preventing the fixing portion 100 from arbitrarily sliding to one side (front side) of the guide portion 200. When the wearer applies an external force to the fixing portion 100 towards one side (front side) of the guide portion 200, the elastic member 300 may deform and move over the second step 270, and the fixing portion 100 may slide to one side (front side) of the guide portion 200.

Figure 8:
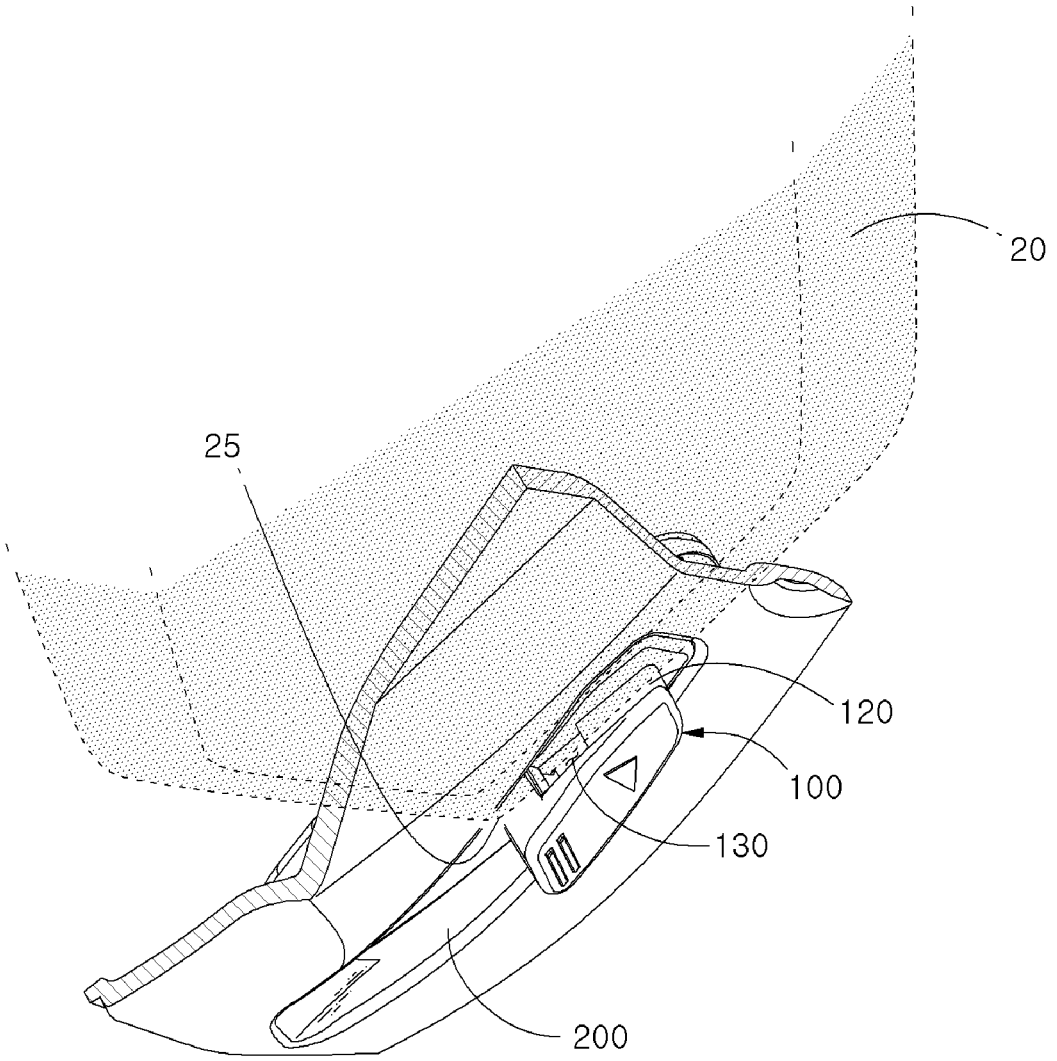
FIGS. 8 and 9 are enlarged perspective views of a rotating body fixing means for a helmet according to an embodiment of the present disclosure.

In addition, as shown in FIG. 8, the fixing portion 100 may have a first groove portion 120 that is recessed. Here, the first groove portion 120 may extend in the lengthwise direction on one surface (upper surface) of the fixing portion 100 that contacts one side (lower side) of the chin guard 20, and have a width corresponding to the thickness of the chin guard 20. Accordingly, when the fixing portion 100 protrudes from the helmet body 10 and come into contact with the chin guard 20, one side (lower side) of the chin guard 20 may be inserted into the first groove portion 120. Thus, the chin guard 20 may be stably fixed by the fixing portion 100.

Figure 9:
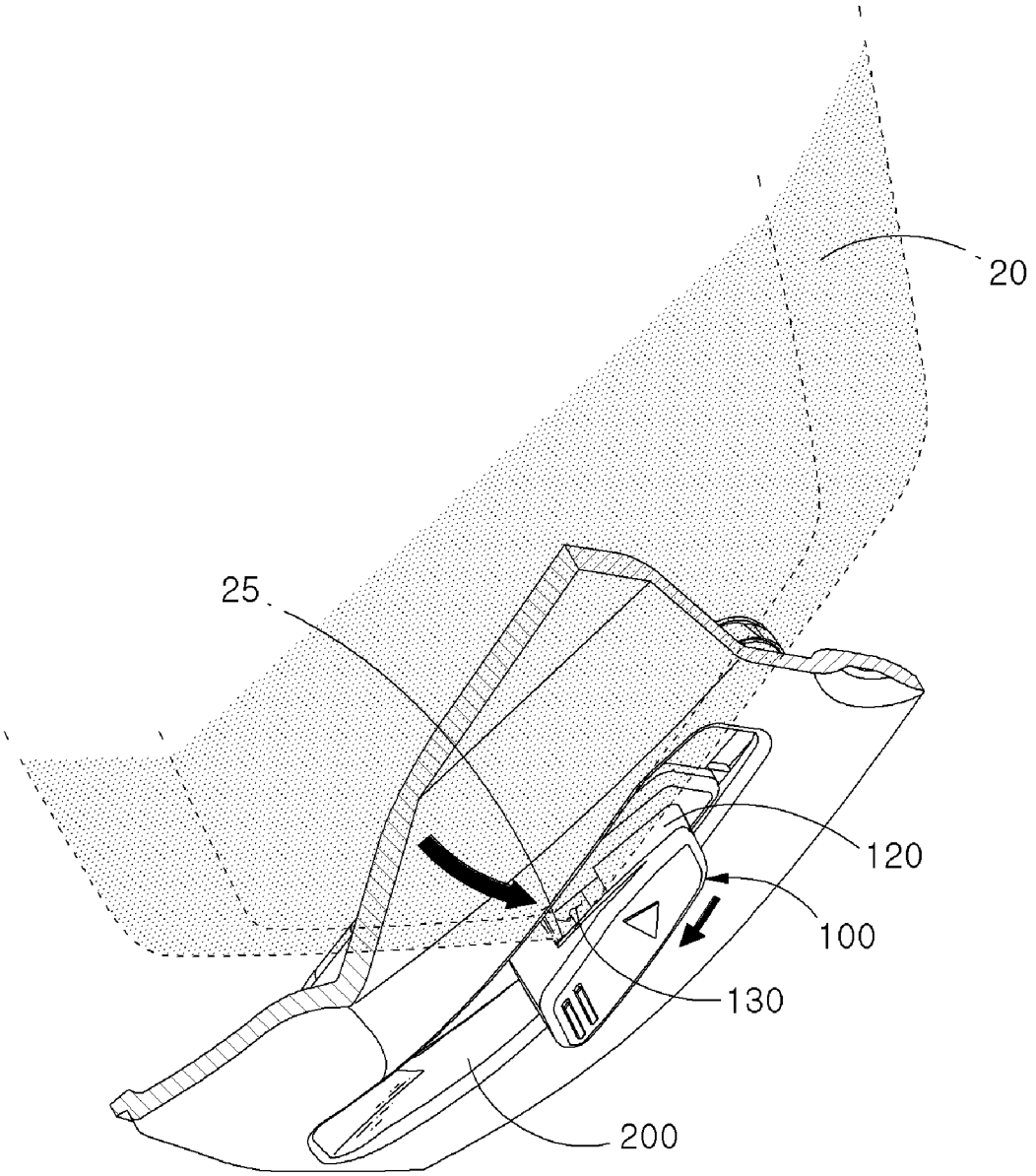

Additionally, as shown in FIG. 9, the first groove portion 120 of the fixing portion 100 may further have a second groove portion 130. Here, the second groove portion 130 may be recessed from one side (front side) of the first groove portion 120, and have a width corresponding to the thickness of the chin guard 20. Accordingly, when an unintentional external force is applied to the chin guard 20 in contact with the fixing portion 100 and the chin guard 20 is forced to rotate, a corner 25 of the chin guard 20 may be inserted into the second groove portion 130 to prevent additional rotation of the chin guard 20. As described above, when the corner 25 of the chin guard 20 is inserted into the second groove portion 130, the fixing portion 100 may move a predefined distance to one side (front side) of the guide portion 200 (see the arrow in FIG. 9). Thus, when the unintentional external force is applied to the chin guard 20, the corner 25 of the chin guard 20 may be inserted into the second groove portion 130, thereby preventing the chin guard 20 from arbitrarily rotating a predetermined angle or more.

MODE FOR INVENTION

Figure 10:
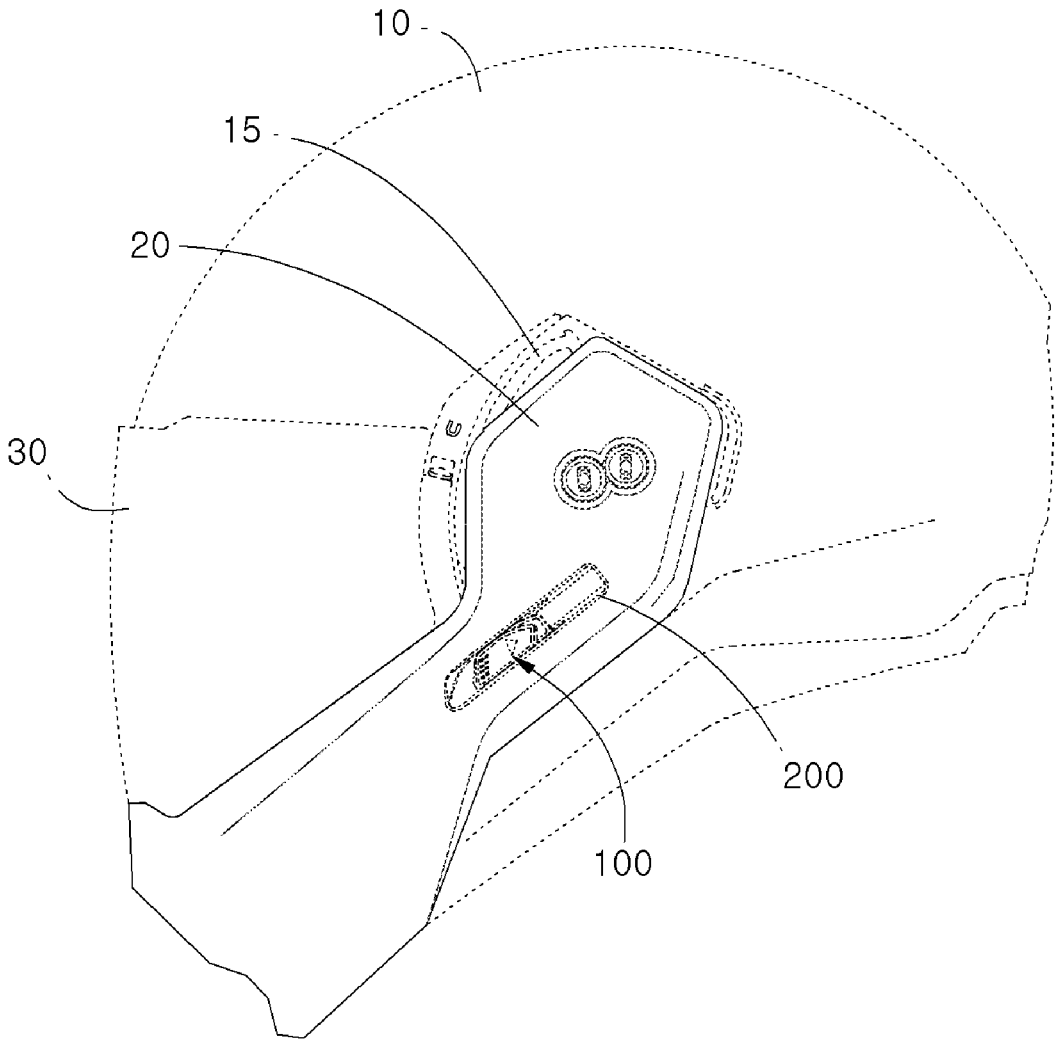
FIGS. 10 to 12 are side views showing an operation process of a rotating body fixing means for a helmet according to an embodiment of the present disclosure.
Figure 11:
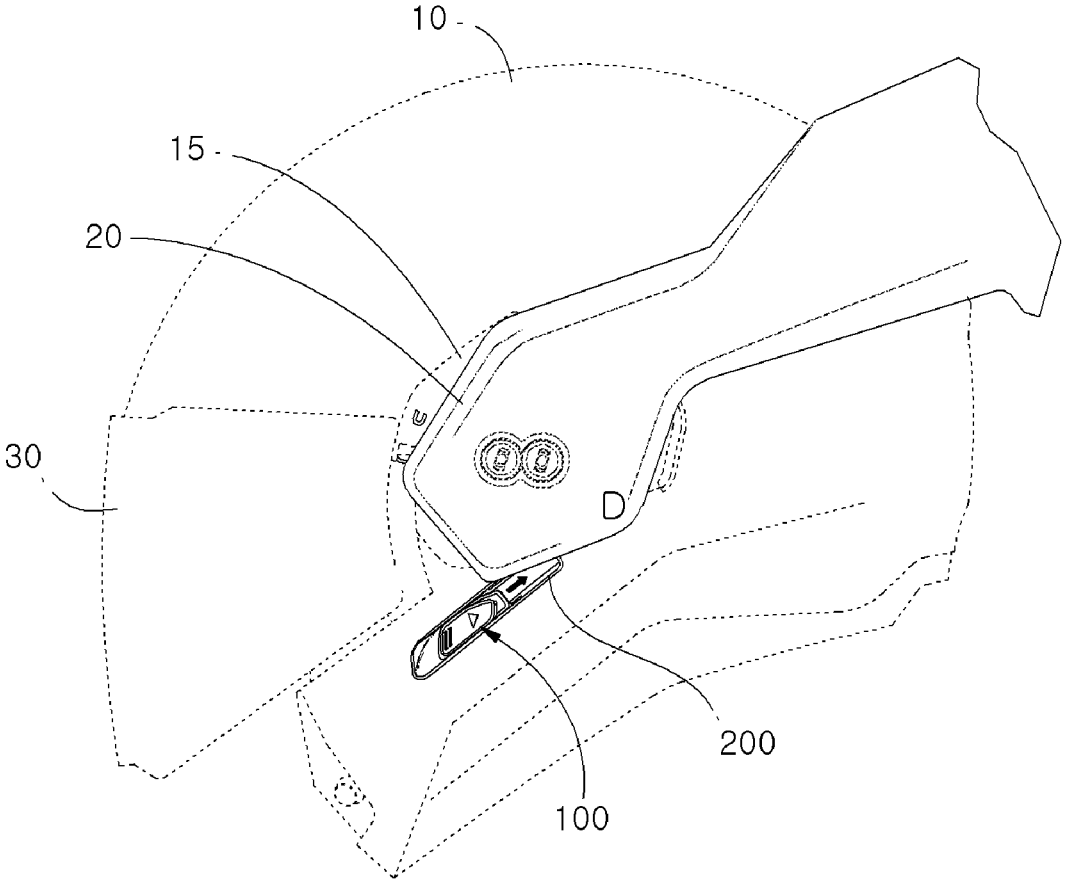
Figure 12:
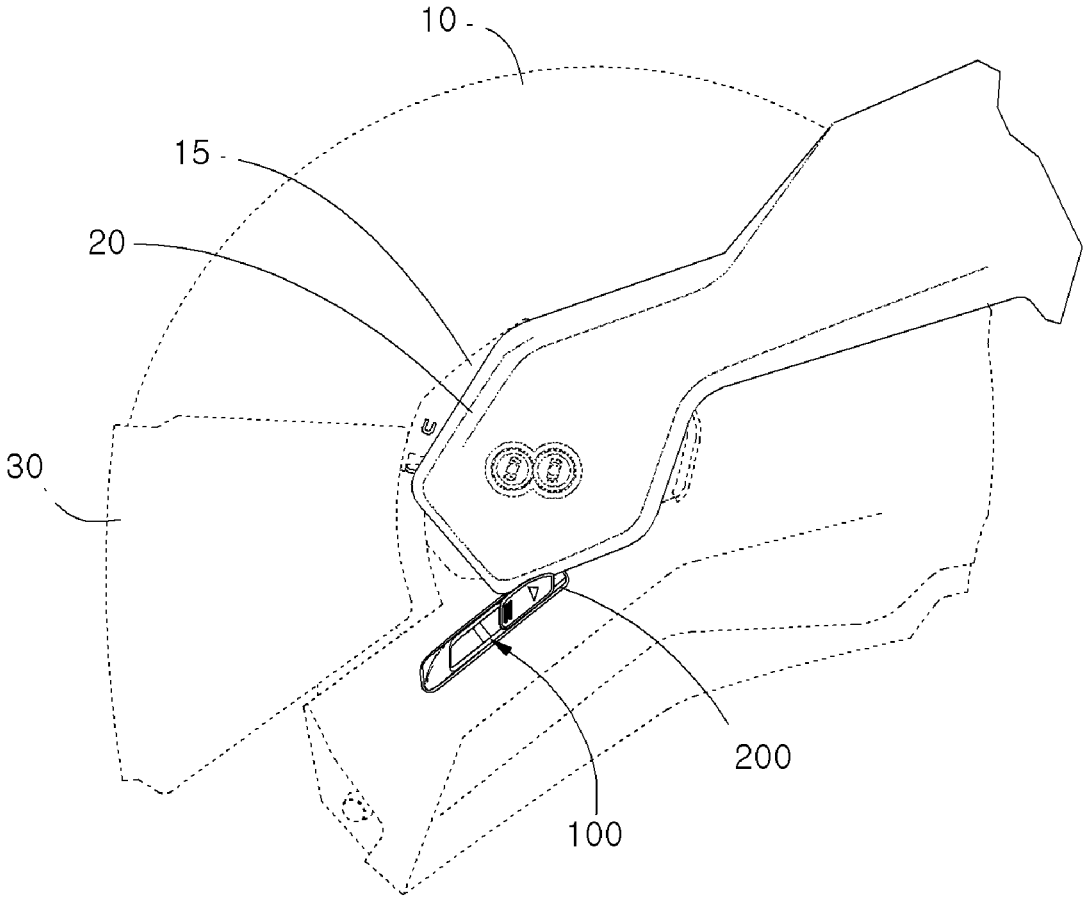

FIGS. 10 to 12 are side views showing an operation process of the rotating body fixing means for the helmet according to an embodiment of the present disclosure, and the operation process of the rotating body fixing means for the helmet according to this embodiment will be described with reference to FIGS. 10 to 12.

To begin with, as shown in FIG. 10, when the chin guard 20 is disposed on the front side of the wearer's chin (Full Face Mode), the fixing portion 100 is disposed on one side (front side) of the guide portion 200, and does not protrude from the helmet body 10 so as not to disturb the rotation of the chin guard 20. In this instance, the elastic member 300 of the fixing portion 100 may be held against the first step 260 of the guide portion 200 to prevent the fixing portion 100 from arbitrarily sliding to the other side (rear side) of the guide portion 200 (see FIG. 6).

Subsequently, as shown in FIG. 11, the chin guard 20 may be rotated and disposed on the rear side of the helmet body 10 (Open Face Mode).

Subsequently, as shown in FIG. 12, when the fixing portion 100 slides from one side (front side) of the guide portion 200 to the other side (rear side), the fixing portion 100 may protrude from the helmet body 10 with the guidance in a manner that the protruding portion 110 of the fixing portion 100 is inserted into the slit 250 of the guide portion 200 (see FIGS. 6 and 7). In this instance, when one surface (upper surface) of the fixing portion 100 contacts one side (lower side) of the chin guard 20, the chin guard 20 may be fixed by the fixing portion 100. More specifically, one side (lower side) of the chin guard 20 may be inserted into the first groove portion 120 of the fixing portion 100 (see FIG. 8), and when the unintentional external force is applied to the chin guard 20 and the chin guard 20 is forced to rotate, the corner 25 of the chin guard 20 may be inserted into the second groove portion 130 of the fixing portion 100 to prevent additional rotation of the chin guard 20 (see FIG. 9). Additionally, the protruding portion 110 of the fixing portion 100 may be held against the second step 270 of the guide portion 200, thereby preventing the fixing portion 100 from arbitrarily sliding to one side (front side) of the guide portion 200 (see FIG. 7).

While the present disclosure has been hereinabove described in detail through the specific embodiments, this is provided to describe the present disclosure in detail, and the present disclosure is not limited thereto, and it is obvious that modifications or changes may be made by those having ordinary skill in the art within the technical spirit of the present disclosure.

Such modifications and changes of the present disclosure fall in the scope of the present disclosure, and the scope of protection of the present disclosure will be apparent from the appended claims.

[Detailed Description of Main Elements]

| | |
|---|---|
| 10: Helmet body | 15: Ratchet |
| 20: Chin guard (Rotating body) | 25: Corner |
| 30: Shield | 100: Fixing portion |
| 110: Protruding portion | 120: First groove portion |
| 130: Second groove portion | 140: Recess portion |
| 200: Guide portion | 210: First guide member |
| 220: Second guide member | 230: Protrusion portion |
| 250: Slit | 260: First step |
| 270: Second step | 300: Elastic member |
| 310: Fastening member | |

INDUSTRIAL APPLICABILITY

The present disclosure provides the rotating body fixing means for the helmet for fixing the rotating body in a simple and stable manner using the fixing portion that changes in the extent to which it protrudes from the helmet body as it slides.

We claim:

1. A rotating body fixing means for a helmet, provided in the helmet including a helmet body and a rotating body rotatably coupled to the helmet body, the rotating body fixing means comprising:

a fixing portion that is linearly slidably disposed on one side of the helmet body, wherein extent of protrusion of the fixing portion with respect to the helmet body varies as the fixing portion slides, wherein the fixing portion is configured to come into contact with the rotating body when protruded from the helmet body, wherein the fixing portion has a first groove portion that is recessed, and wherein when the fixing portion comes into contact with the rotating body, one side of the rotating body is inserted into the first groove portion.

2. The rotating body fixing means for the helmet according to claim 1, wherein the rotating body rotates between a first predefined position with respect to the helmet body and a second predefined position with respect to the helmet body, and wherein when the rotating body is in the second predefined position, the fixing portion protrudes from the helmet body and comes into contact with the rotating body.

3. The rotating body fixing means for the helmet according to claim 1, wherein the rotating body is a chin guard.

4. The rotating body fixing means for the helmet according to claim 1, further comprising:

a guide portion disposed in the helmet body to guide the fixing portion such that extent of protrusion of the fixing portion with respect to the helmet body varies as the fixing portion slides.

5. The rotating body fixing means for the helmet according to claim 4, wherein any one of the fixing portion and the guide portion has a protruding portion that protrudes toward the other of the fixing portion and the guide portion, and wherein the other of the fixing portion and the guide portion has a slit into which the protruding portion is inserted.

6. The rotating body fixing means for the helmet according to claim 5, wherein when the fixing portion has the protruding portion and the guide portion has the slit, the slit extends from one side to the other side along a lengthwise direction of the guide portion, and extends in an outward direction of the helmet body from one side to the other side.

7. The rotating body fixing means for the helmet according to claim 6, wherein the guide portion includes:

a first guide member formed inside the helmet body; and a second guide member coupled to the first guide member, and wherein the slit is formed between the first guide member and the second guide member.

8. The rotating body fixing means for the helmet according to claim 5, wherein when the guide portion has the protruding portion and the fixing portion has the slit, the protruding portion extends from one side to the other side along a lengthwise direction of the guide portion, and extends in an outward direction of the helmet body from one side to the other side.

9. The rotating body fixing means for the helmet according to claim 5, wherein the fixing portion is provided with an elastic member, and the elastic member compresses the fixing portion in a direction, and wherein when the protruding portion of the fixing portion goes through a second step of the guide portion, one side of the protruding portion is held against the second step.

10. The rotating body fixing means for the helmet according to claim 9, wherein the elastic member is a torsion spring.

11. The rotating body fixing means for the helmet according to claim 4, wherein the guide portion has a protrusion portion that extends along a lengthwise direction and protrudes toward the fixing portion, and wherein the fixing portion has a recess portion into which the protrusion portion is inserted.

12. The rotating body fixing means for the helmet according to claim 4, wherein the fixing portion is provided with an elastic member, and wherein when the elastic member comes into contact with the guide portion, the elastic member compresses the fixing portion in an outward direction of the helmet body.

13. The rotating body fixing means for the helmet according to claim 12, wherein the elastic member is a torsion spring.

14. The rotating body fixing means for the helmet according to claim 4, wherein the fixing portion is provided with an elastic member, and wherein the guide portion has a first step, against which the elastic member is held.

15. The rotating body fixing means for the helmet according to claim 14, wherein the elastic member is a torsion spring.

16. The rotating body fixing means for the helmet according to claim 1, wherein the first groove portion has a second groove portion that is recessed, and wherein with the rotation of the rotating body, a corner of the rotating body is inserted into the second groove portion.

17. A rotating body fixing means for a helmet, provided in the helmet including a helmet body and a rotating body rotatably coupled to the helmet body, the rotating body fixing means comprising:

a fixing portion that is linearly slidably disposed on one side of the helmet body, wherein extent of protrusion of the fixing portion with respect to the helmet body varies as the fixing portion slides, and wherein the fixing portion is configured to come into contact with the rotating body when protruded from the helmet body; and a guide portion disposed in the helmet body to guide the fixing portion such that extent of protrusion of the fixing portion with respect to the helmet body varies as the fixing portion slides, wherein any one of the fixing portion and the guide portion has a protruding portion that protrudes toward the other of the fixing portion and the guide portion, and wherein the other of the fixing portion and the guide portion has a slit into which the protruding portion is inserted.

18. The rotating body fixing means for the helmet according to claim 17, wherein the slit extends from one side to the other side along a lengthwise direction of the guide portion and in an outward direction of the helmet body from one side to the other side when the fixing portion has the protruding portion and the guide portion has the slit, and wherein the protruding portion extends from one side to the other side along a lengthwise direction of the guide portion and extends in an outward direction of the helmet body from one side to the other side when the guide portion has the protruding portion and the fixing portion has the slit.

19. The rotating body fixing means for the helmet according to claim 17, wherein the rotating body rotates between a first predefined position with respect to the helmet body and a second predefined position with respect to the helmet body, and wherein when the rotating body is in the second predefined position, the fixing portion protrudes from the helmet body and comes into contact with the rotating body.

20. A rotating body fixing means for a helmet, provided in the helmet including a helmet body and a rotating body rotatably coupled to the helmet body, the rotating body fixing means comprising:

a fixing portion that is linearly slidably disposed on one side of the helmet body, wherein extent of protrusion of the fixing portion with respect to the helmet body varies as the fixing portion slides, and wherein the fixing portion is configured to come into contact with the rotating body when protruded from the helmet body;

a guide portion disposed in the helmet body to guide the fixing portion such that extent of protrusion of the fixing portion with respect to the helmet body varies as the fixing portion slides, wherein the fixing portion is provided with an elastic member, and wherein when the elastic member comes into contact with the guide portion, the elastic member compresses the fixing portion in an outward direction of the helmet body.

* * * * *